US009754746B2

(12) United States Patent
Broker et al.

(10) Patent No.: US 9,754,746 B2
(45) Date of Patent: Sep. 5, 2017

(54) DUAL VOLTAGE LEVEL CIRCUIT FOR DRIVING A LATCHING RELAY

(71) Applicant: Emerson Electric Co., St. Louis, MO (US)

(72) Inventors: John F. Broker, Warrenton, MO (US); Xiaobing Zhu, Chesterfield, MO (US); Cuikun Chu, Xi'an (CN)

(73) Assignee: Emerson Electric Co., St. Louis, MO (US)

( * ) Notice: Subject to any disclaimer, the term of this patent is extended or adjusted under 35 U.S.C. 154(b) by 372 days.

(21) Appl. No.: 14/693,067

(22) Filed: Apr. 22, 2015

(65) Prior Publication Data

US 2016/0314919 A1 Oct. 27, 2016

(51) Int. Cl.
*H01H 47/00* (2006.01)
*H01H 47/32* (2006.01)
*H01H 47/22* (2006.01)

(52) U.S. Cl.
CPC ..... *H01H 47/32* (2013.01); *H01H 47/226* (2013.01)

(58) Field of Classification Search
CPC ..... H01H 47/32
USPC ..... 361/190
See application file for complete search history.

(56) References Cited

U.S. PATENT DOCUMENTS 3,866,216 A * 2/1975 Tschumi ..... G08B 5/24 318/96
4,747,010 A * 5/1988 Bayer ..... H01H 51/2281 335/177
5,016,134 A 5/1991 Chang et al.
6,111,373 A * 8/2000 Ohashi ..... E05F 15/695 318/265
6,119,950 A * 9/2000 Albanello ..... G05D 23/1904 165/267
6,738,250 B2 * 5/2004 Joseph ..... H01H 47/223 361/144

(Continued)

FOREIGN PATENT DOCUMENTS

CN 202678217 U 1/2013
WO WO2009/041969 4/2009

OTHER PUBLICATIONS

ON Semiconductor; http://onsemi.com; NPN Transistors with Monolithic Bias Resistor Network; Feb. 2013; 11 pgs.

(Continued)

*Primary Examiner* — Stephen W Jackson
(74) *Attorney, Agent, or Firm* — Harness, Dickey & Pierce, P.L.C.

(57) ABSTRACT

A driving circuit includes a relay driver for selectively connecting a relay coil with (a) a first current path between the relay driver and a relay voltage input or (b) a second current path between the relay driver and a ground connection. Another relay driver selectively connects the coil with (a) a third current path between the other relay driver and the relay voltage input or (b) a fourth current path between the other relay driver and the ground connection. The relay drivers may connect the coil between the second and third current paths for latching the relay, and between the first and fourth current paths for unlatching the relay. The driving circuit applies signals of opposite polarity and different magnitudes through the coil to latch and unlatch the relay. The signal for unlatching can be of lower voltage than the signal for latching the relay.

14 Claims, 5 Drawing Sheets

(56) References Cited

U.S. PATENT DOCUMENTS 7,593,212 B1 * 9/2009 Toth ..... G05D 23/1902
361/153

OTHER PUBLICATIONS

"200 Transistor Circuits", Colin Mitchell; Feb. 11, 2013; 103 pgs.

* cited by examiner

DUAL VOLTAGE LEVEL CIRCUIT FOR DRIVING A LATCHING RELAY

FIELD

The present disclosure generally relates to latching relays, and more particularly (but not exclusively) to a dual voltage level circuit for driving a latching relay.

BACKGROUND

This section provides background information related to the present disclosure which is not necessarily prior art.

Latching relays are often used in thermostats and other climate control system controllers to connect and disconnect various climate control system components during system operation. For example, a thermostat may initiate and subsequently terminate a cooling cycle by latching and subsequently de-latching a relay between a compressor and a power source.

SUMMARY

This section provides a general summary of the disclosure, and is not a comprehensive disclosure of its full scope or all of its features.

According to various aspects, exemplary embodiments are disclosed of relay driver circuits and related methods. In an exemplary embodiment, a driving circuit for driving a relay generally includes a first relay driver for selectively connecting a coil of the relay with (a) a first current path between the first relay driver and a relay voltage input or (b) a second current path between the first relay driver and a ground connection. A second relay driver is provided for selectively connecting the coil with (a) a third current path between the second relay driver and the relay voltage input or (b) a fourth current path between the second relay driver and the ground connection. The relay drivers are operable to connect the coil with the second and third current paths to configure the driving circuit for latching the relay, and operable to connect the coil with the first and fourth current paths to configure the driving circuit for unlatching the relay. The driving circuit is further operable to apply a first signal from the relay voltage input through the coil to latch the relay, and to apply a second signal from the relay voltage input through the coil to unlatch the relay. The first and second signals have opposite polarities and different voltage magnitudes.

In another exemplary embodiment, a driving circuit is provided for driving a relay having a coil. A first relay driver has first and second switches selectively switchable to connect a first end of the coil with (a) a first current path between the first switch and a relay voltage input or (b) a second current path between the second switch and a ground connection. A second relay driver has third and fourth switches selectively switchable to connect a second end of the coil with (a) a third current path between the third switch and the relay voltage input or (b) a fourth current path between the fourth switch and the ground connection. The switches are operable to connect the coil between the second and third current paths to configure the driving circuit for latching of the relay, and operable to connect the coil between the first and fourth current paths to configure the driving circuit for unlatching of the relay. The driving circuit is further configured to apply a first signal from the relay voltage input through the third switch to latch the relay, and to apply a second signal from the relay voltage input through the first switch to unlatch the relay. The first and second signals have opposite polarities. The first switch is operable to unlatch the relay upon receiving the second signal at a voltage magnitude lower than a voltage magnitude of the first signal by which the third switch is operable to latch the relay.

Also disclosed are methods that generally include a method of driving a relay. The method includes connecting first and second ends of a coil of the relay between a relay voltage input and a ground connection in response to a pair of processor signals. The method further includes, based on the connecting, receiving at the relay voltage input a voltage signal having a magnitude sufficient to latch and/or unlatch the relay, and transmitting the voltage signal through the coil, the magnitude being lower for unlatching the relay than for latching the relay.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The inventors hereof have observed that sometimes low-voltage conditions can arise when a thermostat is latching and/or unlatching relays during operation of a climate control system. A situation could arise, for example, in which a relay that has been latched on to initiate a heating or cooling cycle cannot be unlatched, because available voltage has dropped below a level sufficient to unlatch the relay. The inventors have also recognized that it can be beneficial, e.g., during low-voltage conditions, to make it more difficult to latch a relay than to unlatch the same relay.

Accordingly, the inventors have developed and disclose herein exemplary embodiments of relay driving circuits that can use a lower voltage to unlatch a relay than would be used to latch the relay. For example, in some embodiments, where a given magnitude of voltage input is available to a relay driving circuit for energizing a relay coil, the relay driving circuit is operable to provide an energizing signal to the coil that is sufficient to unlatch the relay, whereas the same voltage input magnitude would not be sufficient to provide an energizing signal to the coil for latching the relay.

Figure 1:
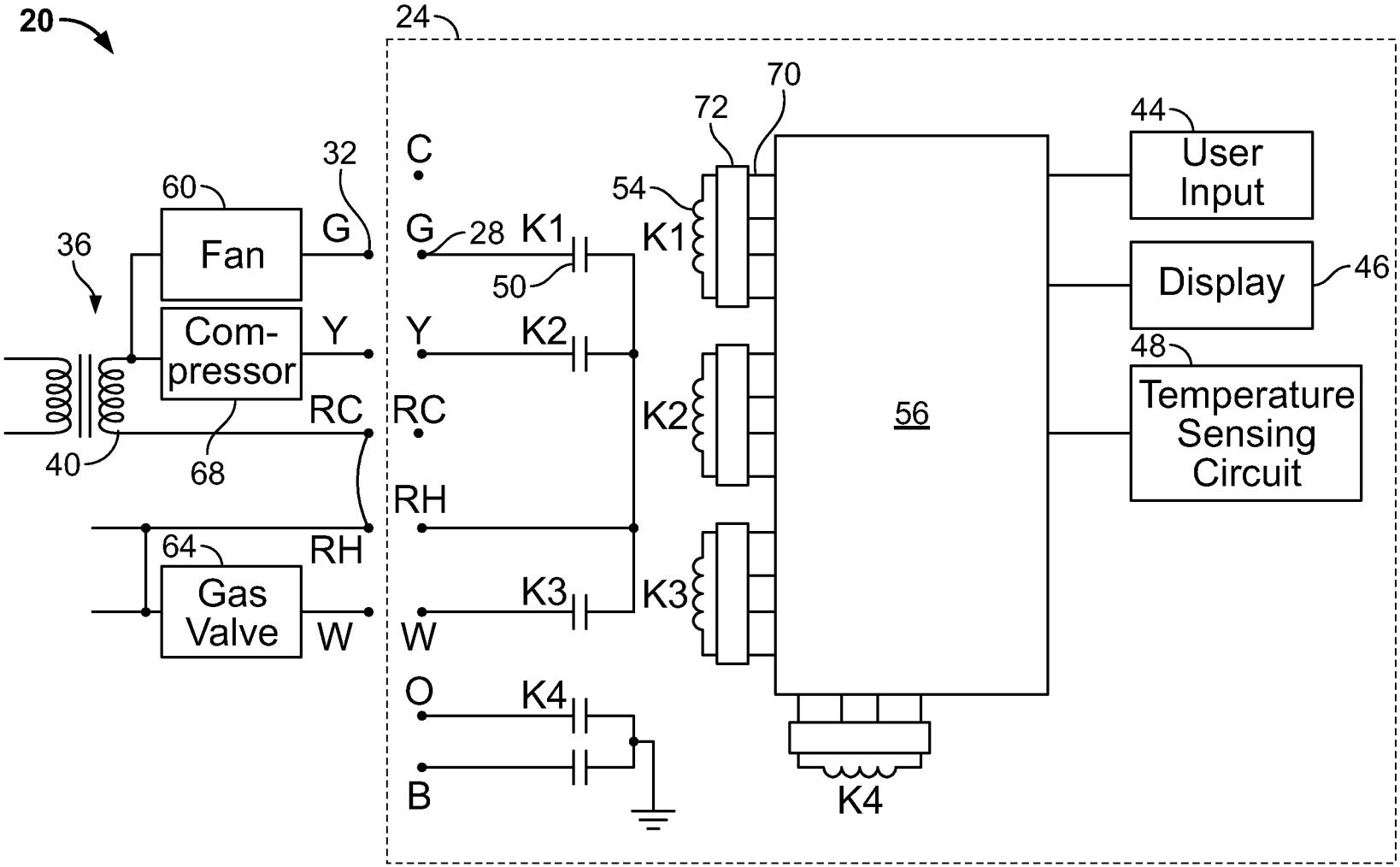
FIG. 1 is a diagram of part of a heating, ventilating and air conditioning (HVAC) system including a thermostat in accordance with one example embodiment of the disclosure.

With reference now to the figures, FIG. 1 illustrates part of an HVAC system 20 embodying one or more aspects of the present disclosure. The HVAC system 20 is controllable by an exemplary embodiment of a thermostat 24. Electrical terminals 28 of the thermostat 24 are provided for connection to electrical terminals 32 of the HVAC system 20. The thermostat 24 obtains power, e.g., from a 120 VAC source through a system power transformer 36, which provides a secondary voltage, e.g., of 24 VAC, across a secondary coil 40. Other or additional transformers, voltages, and/or terminals, however, could be provided in other embodiments.

The example thermostat 24 includes user input device(s) 44, e.g., a keypad, buttons, etc., a display 46, e.g., an LCD display on which thermostat status and other information may be displayed, and a temperature sensing circuit 48. The thermostat 24 also includes a plurality of latching relays referred to generally as Kn, e.g., relays K1, K2, K3 and K4 each having contacts 50 movable by energizing a corresponding coil 54. A microprocessor 56 is configured to operate the latching relays K1, K2, K3 and/or K4 to connect the transformer 36 secondary voltage at a terminal RH to various HVAC loads, e.g., a fan 60 through a terminal connection G, a gas valve 64 through a terminal connection W, and/or a compressor 68 through a terminal connection Y. It will be appreciated that various thermostat embodiments can include more or fewer and/or different terminal connections and/or latching relays, e.g., that might be used in relation to a given HVAC system. For example, the thermostat 24 includes terminals O and B and the relay K4 for heat pump operation, but the terminals O and B and the relay K4 are not used in relation to the present example HVAC system 20.

The microprocessor 56 is configured, e.g., programmed, to provide output signals via output pins 70 to operate relay driver switches 72 for controlling the latching relays Kn. In the present example embodiment, the microprocessor 56 may establish requests for heating or cooling by operating latching relays K1, K2 and/or K3 to cause the transformer 36 secondary voltage to be connected through the terminal RH to the appropriate terminal(s) G, Y and/or W. In various embodiments, a latching relay Kn is "latched," e.g., its contacts 50 are closed, when its coil 54 is energized by a momentary application, e.g., a pulse, of DC voltage of a first polarity lasting an appropriate length of time, e.g., measured in milliseconds. In such embodiments, a "latched" relay Kn is "unlatched," e.g., its contacts 50 are opened, when its coil 54 is energized by a momentary application e.g., a pulse, of DC voltage of a second polarity opposite the first polarity. If, for example, heating is to be initiated, the microprocessor 56 may latch the relay K3 by energizing the coil 54 of the relay K3 for a time period sufficient to close the contacts 50 of the relay K3 for switching voltage to the W terminal to activate the gas valve 64. After heating has been initiated, the microprocessor 56 may terminate the heating by unlatching the relay K3.

The microprocessor 56 may initiate cooling by energizing the coil 54 of the relay K2 to close the contacts 50 of the relay K2 for switching voltage to the compressor terminal Y, to activate the compressor 68. The fan 60 may be controlled through the relay K1. When either the compressor 68 or gas valve 64 is on, typically the microprocessor 56 also operates the fan 60. In the present example embodiment, once a latching relay Kn is latched (or unlatched) by application of a voltage, the relay Kn stays latched (or unlatched) until a voltage of the opposite polarity is applied as previously described. In the present example embodiment, while a relay Kn remains in either the latched or unlatched state, no current flows to the coil 54 of that relay Kn between application of the voltages. Embodiments are possible, however, in which at least some current may flow through a relay coil after the relay has been latched or unlatched.

In various embodiments, a latching relay driving circuit is provided that applies a first energizing signal to the coil of a relay to latch the relay, and applies to the coil a second energizing signal to unlatch the relay, where the second energizing signal may have a voltage magnitude lower than that of the first energizing signal. In various embodiments, a relay driving circuit that is capable of applying a lower voltage to unlatch a relay than to latch the relay can be operated to unlatch the relay, e.g., when low voltage conditions reduce the input voltage available to the relay.

Figure 2:
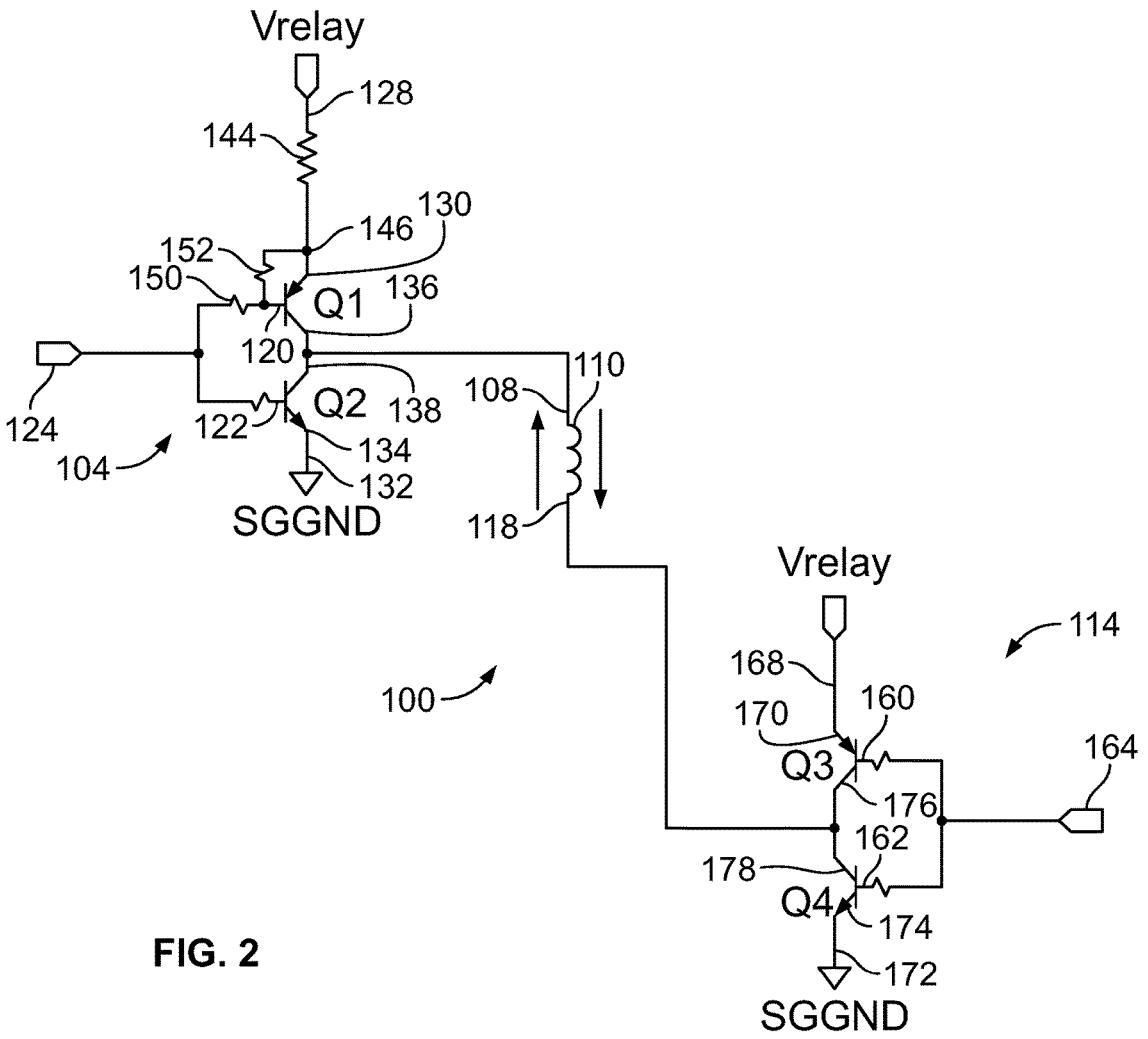
FIG. 2 is a diagram of a relay driving circuit in accordance with one example embodiment of the disclosure.

One example embodiment of a relay driving circuit is indicated generally in FIG. 2 by reference number 100. The relay driving circuit 100 includes a first relay driver 104 connected with a first end 108 of a latching relay coil 110. The relay driving circuit 100 also includes a second relay driver 114 connected with a second end 118 of the coil 110. The first relay driver 104 includes two switches, e.g., a PNP transistor Q1 and an NPN transistor Q2. The bases 120 and 122 of the transistors Q1 and Q2 are connected with a pin 124 of a microprocessor (not shown in FIG. 2) for receiving input from the microprocessor. A first current path 128 is provided between a relay voltage input Vrelay and the emitter 130 of the PNP transistor Q1. A second current path 132 is provided between a ground connection, e.g., a signal ground SGGND, and the emitter 134 of the NPN transistor Q2. The collectors 136 and 138 of the transistors Q1 and Q2 are both connected with the first end 108 of the relay coil 110.

A resistance 144 may be provided in the first current path 128, between the relay voltage input Vrelay and a node 146. A resistance 150 is provided in series with the base 120 of the PNP transistor Q1. Another resistance 152 is provided between the base 120 and emitter 130 of the PNP transistor Q1. In some embodiments, the transistor Q1 and resistors 150 and 152 are provided together in a digital transistor, e.g., as indicated generally in FIG. 3 by reference number 200. The transistor 200 has built-in internal resistances R1 and R2. The digital transistor 200 may be, for example, a bias resistor transistor (BRT), e.g., a PNP transistor with a monolithic bias network, from ON Semiconductor, http://onsemi.com.

The second relay driver 114 includes two switches, e.g., a PNP transistor Q3 and an NPN transistor Q4. The bases 160 and 162 of the transistors Q3 and Q4 are connected with a microprocessor pin 164 for receiving input from the microprocessor. A third current path 168 is provided between the relay voltage input Vrelay and the emitter 170 of the PNP transistor Q3. A fourth current path 172 is provided between the signal ground SGGND and the emitter 174 of the NPN transistor Q4. The collectors 176 and 178 of the transistors Q3 and Q4 are both connected with the second end 118 of the relay coil 110.

The first and second relay drivers 104 and 114 are operable by the microprocessor to selectively activate the latching relay coil 110, to selectively close and open the relay contacts (not shown in FIG. 2). For example, to latch the relay, the microprocessor outputs a positive signal, e.g., a "1" to the second relay driver 114 via the pin 164. When the positive signal is applied via the pin 164 to the base 160 of the PNP transistor Q3, the transistor Q3 is activated to connect the second end 118 of the relay coil 110 with the relay voltage input Vrelay via the third current path 168. The microprocessor also outputs a "0" signal to the first relay driver 104 via the pin 124. When the "0" signal is applied via the pin 124 to the base 122 of the transistor Q2, the transistor Q2 is activated to connect the first end 108 of the relay coil 110 with the signal ground SGGND via the second current path 132.

In various embodiments, when the relay drivers 104 and 114 have connected the coil 110 between the second and third current paths 132 and 168, the microprocessor causes the driving circuit 100 to apply a signal, e.g., a pulse, of a first polarity, e.g., from the relay voltage input Vrelay, through the PNP transistor Q3, the coil 110, and the NPN transistor Q2, to the signal ground SGGND. In some embodiments, a pulse from the relay voltage input Vrelay is applied to latch the coil 110 after a switch (not shown) of the driving circuit 100 is switched to apply the pulse to the coil 110.

In the present example embodiment, to unlatch the relay, the microprocessor outputs a positive signal, e.g., a "1" to the first relay driver 104 via the pin 124. When the positive signal is applied via the pin 124 to the base 120 of the PNP transistor Q1, the transistor Q1 is activated to connect the first end 108 of the relay coil 110 with the relay voltage input Vrelay via the first current path 128. The microprocessor also outputs a "0" signal to the second relay driver 114 via the pin 164. When the "0" signal is applied via the pin 164 to the base 162 of the transistor Q4, the transistor Q4 is activated to connect the second end 118 of the relay coil 110 with the signal ground SGGND via the fourth current path 172.

In various embodiments, when the relay drivers 104 and 114 have connected the coil 110 between the first and fourth current paths 128 and 172, the microprocessor causes the driving circuit 100 to apply a signal, e.g., a pulse, of a second polarity, e.g., from the relay voltage input Vrelay, through the PNP transistor Q1, the coil 110, and the NPN transistor Q4, to the signal ground SGGND. In some embodiments, a pulse from the relay voltage input Vrelay is applied to unlatch the coil 110 after a switch (not shown) of the driving circuit 100 is switched to apply the pulse to the coil 110. Example devices and values for the driving circuit 100 are as follows:

Vrelay: 2.3V
coil 110: 1.5V
Q1 and Q3: NXP PDTB113ZT
Q2 and Q4: Diodes Inc. DDTC123TKA-7-F It should be noted that in various embodiments, a pulse signal voltage applied at the first end 108 of the coil 110 to unlatch the relay may be lower than a pulse signal voltage applied at the second end 118 of the coil 110 to latch the relay. In the example driving circuit 100, resistances (150, 152), or resistances (R1, R2) where Q1 is a BRT transistor, configure a Vce voltage drop between the Q1 emitter 130 and collector 136 that can be small compared, e.g., to Vce voltage drops in the transistors Q2-Q4. In some embodiments, for a given signal input to transistors Q1 and, e.g., Q3, the transistor Q1 may provide a voltage level at its collector 136 that is higher compared to the voltage level provided at the collector 176 of the transistor Q3. The operability of the transistor Q1 at a lower input voltage level can make it possible for the relay to be unlatched, e.g., when the relay voltage input Vrelay is reduced below usual operating levels, e.g., to a voltage level at which the transistor Q3 could not be operable to latch the relay.

Figure 4:
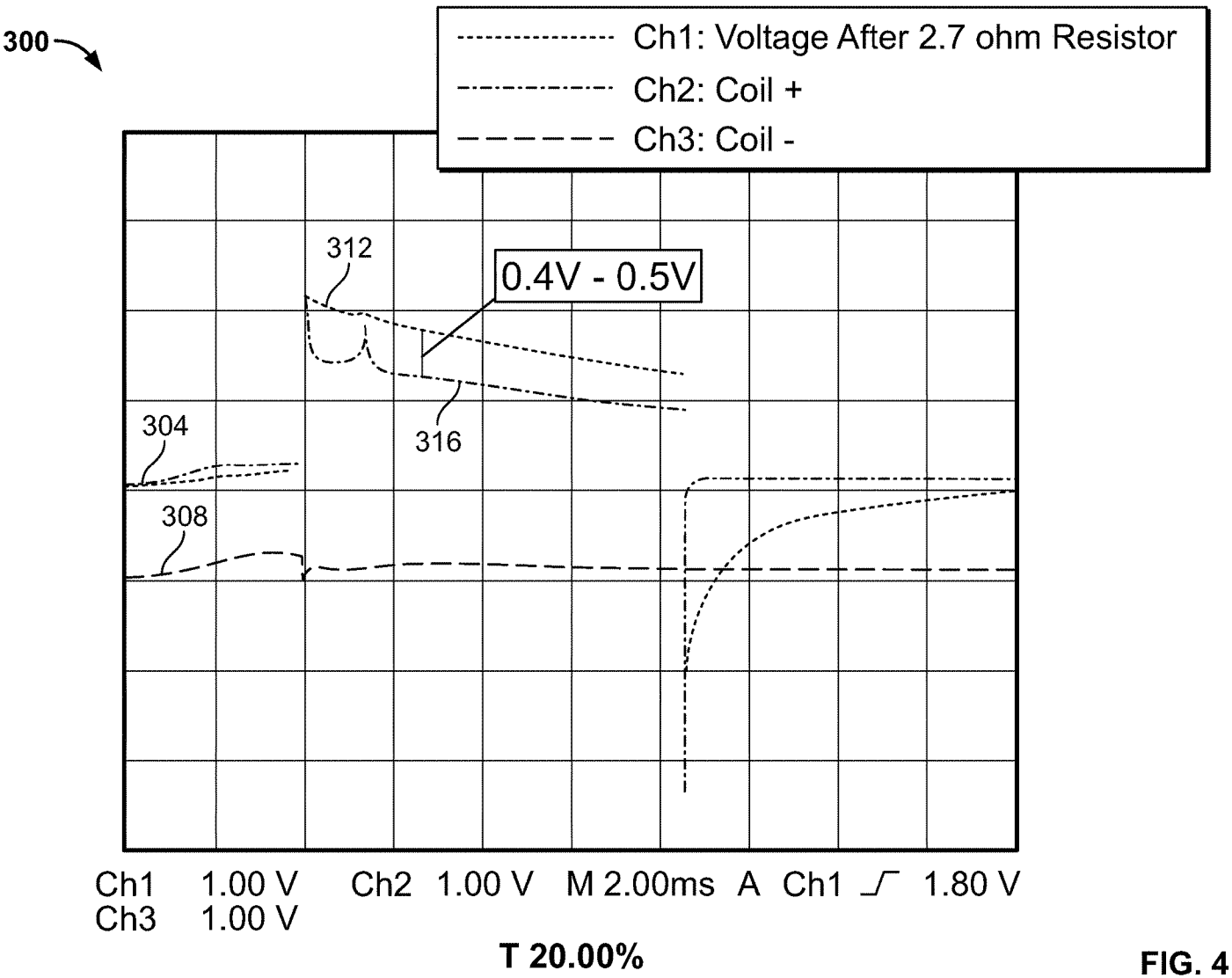
FIG. 4 is an illustration of an oscilloscope screen showing performance of a transistor in relation to a relay coil.

FIG. 4 illustrates an oscilloscope screen 300 showing performance of a transistor in relation to a relay coil, where resistance is not provided as, e.g., would be provided in a BRT transistor. In the circuit referred to in FIG. 4, a 2.7-ohm resistance was provided between a relay voltage input and the transistor emitter. Signals 304 indicate initial voltages at the relay voltage input and the first end of the coil. A signal 308 indicates initial voltage at the second end of the coil. The signals 304 and 308 were initially at about 0 volts. A signal 312 from the relay voltage input produced a signal 316 at the transistor collector that was 0.4-0.5 volts less than that of the relay voltage input signal 312. The inventors observed that the voltage drop on Vce of the transistor was large enough to prevent normal unlatching of the relay at a low operating voltage, e.g., at 2.3 volts.

Figure 3:
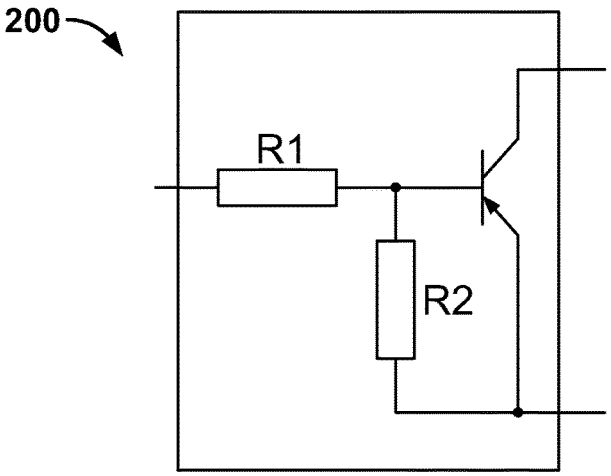
FIG. 3 is a diagram of an equivalent circuit of a transistor for use in a relay driving circuit in accordance with one example embodiment of the disclosure.
Figure 5:
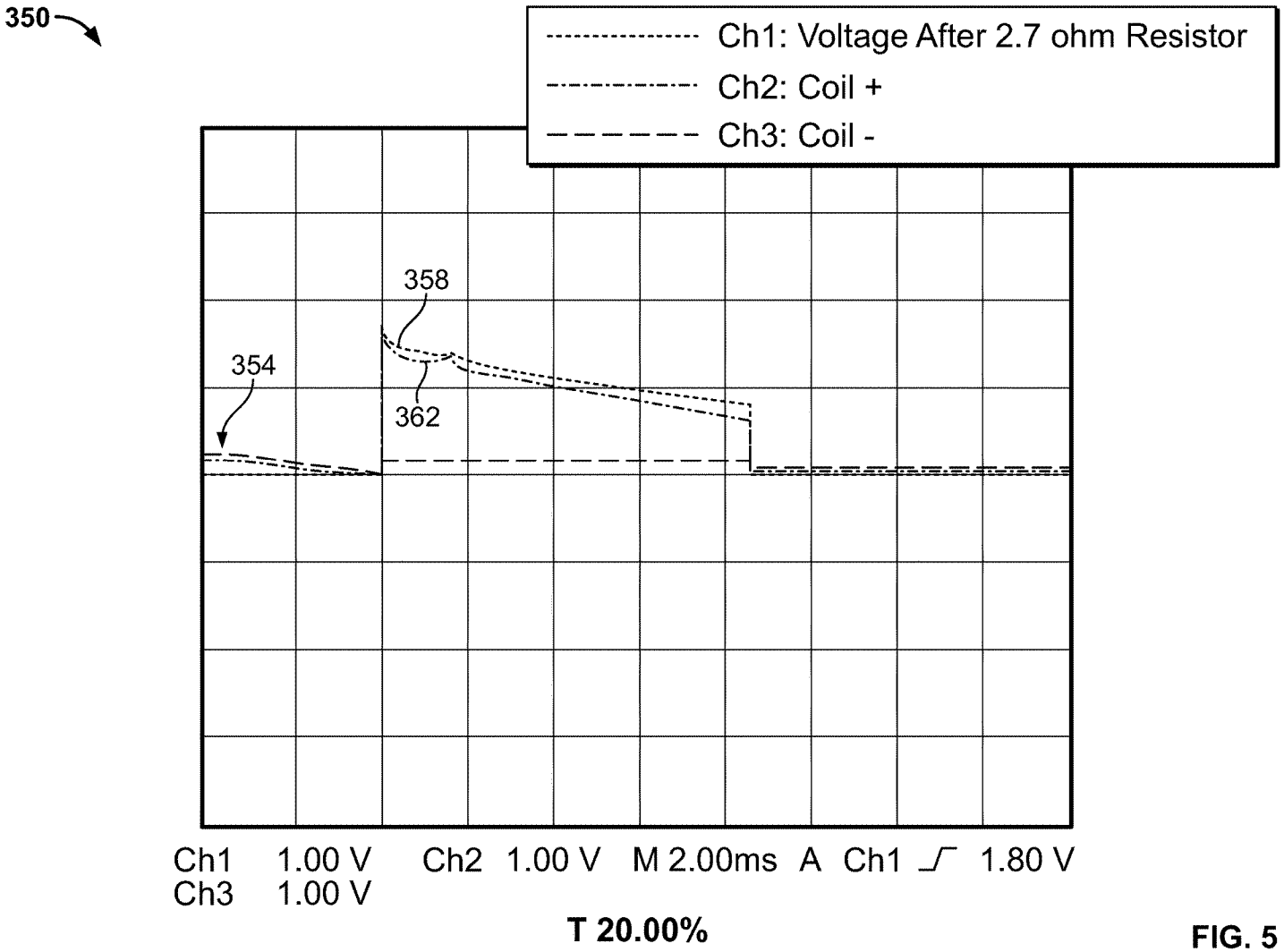
FIG. 5 is an illustration of an oscilloscope screen showing performance of a BRT transistor in accordance with one example embodiment of the disclosure.

FIG. 5 illustrates an oscilloscope screen 350 showing performance of a BRT transistor in accordance with one example embodiment of the disclosure. The transistor used in the circuit discussed with reference to FIG. 4 was replaced in the circuit with a BRT transistor having built-in resistance, e.g., as shown in FIG. 3. Signals 354 indicate initial voltages at the relay voltage input and at both ends of the coil. The signals 354 were initially at about 0 volts. A signal 358 from the relay voltage input produced a signal 362 at the transistor collector that was about 0.12 volts less than that of the relay voltage input signal 358. The inventors observed that the voltage drop on Vce of the transistor was sufficiently small to allow normal unlatching of the relay at the low operating voltage, e.g., at 2.3 volts.

The resistances, transistors, circuits, etc. described above are examples only, and other or additional components and/or component values could be used in various relay driving circuit embodiments. In some embodiments, a relay driving circuit may be operable to unlatch a relay when the relay voltage input signal is as low as 2 volts. Driving circuit embodiments in which the voltage needed to unlatch a relay is less than the voltage needed to latch the relay can help prevent a situation in which a relay has been latched on, e.g., to initiate a heating or cooling cycle, but cannot be unlatched, e.g., when operating voltage has dropped to a level too low at which to unlatch the relay. Such a feature can be useful, e.g., in battery-powered thermostats.

Figure 6:
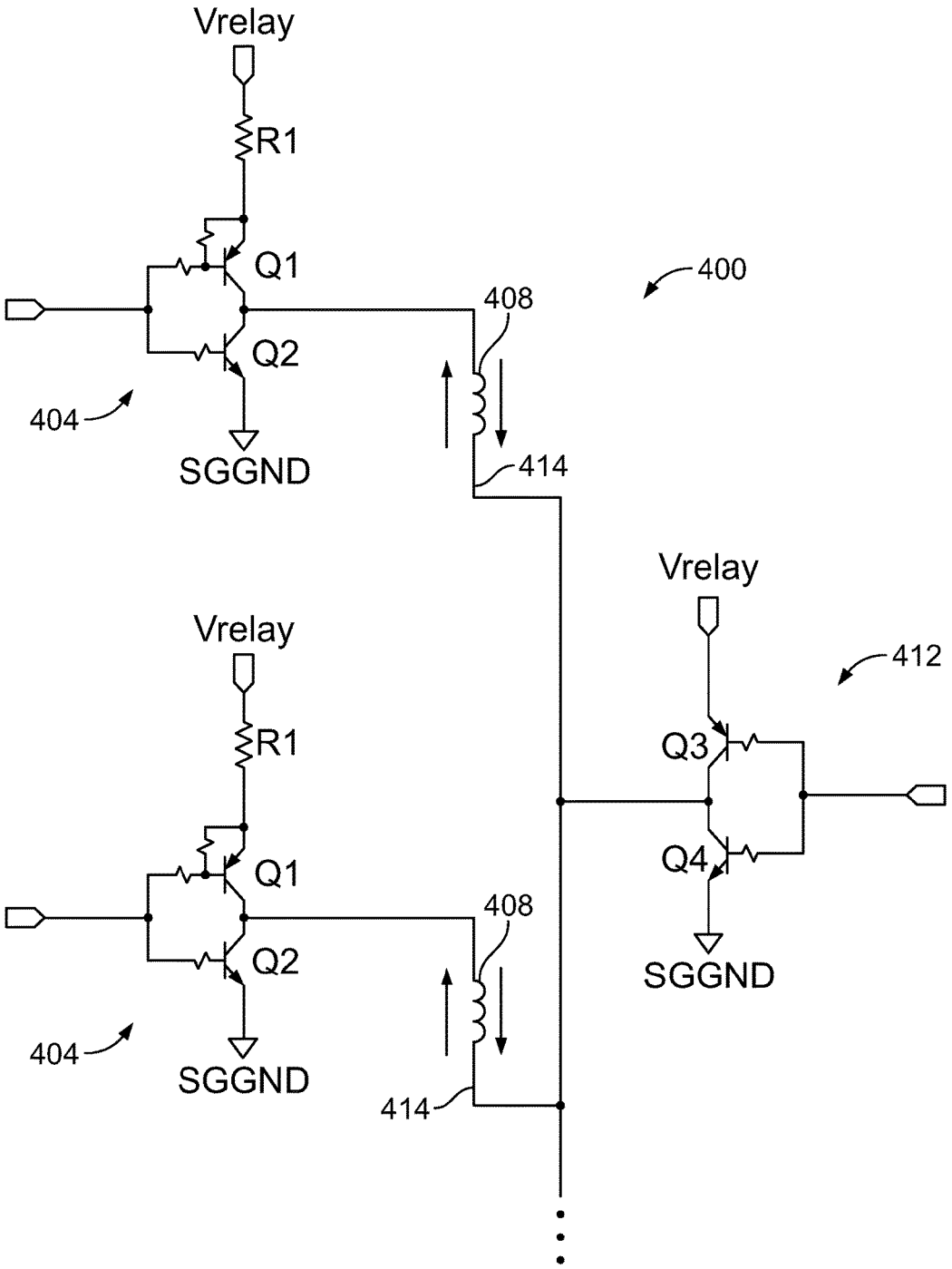
FIG. 6 is a diagram of a relay driving circuit in accordance with one example embodiment of the disclosure.

In various embodiments, a relay driving circuit may be configured to drive more than one relay. In one example embodiment shown in FIG. 6, a driving circuit 400 includes two individual relay drivers 404, e.g., for driving the coils 408 of two relays. The relay driving circuit 400 also includes a common driver 412 connected with a second end 414 of each coil 408. In various embodiments, a relay drive matrix may be provided to drive a plurality of relays, e.g., as described in U.S. Pat. No. 7,593,212, the entire disclosure of which is incorporated herein by reference. In the present example embodiment, the individual relay driving circuits 404 each include a switch Q1 that may be provided, e.g., as a BRT transistor as previously discussed with reference to FIGS. 2 and 3. In some other embodiments, the common driver switch Q3, instead of switches Q1 of the individual relay drivers 404, may be provided as a BRT transistor. In such embodiments, the common relay driver 412 could provide low-voltage unlatching functionality for the individual relay drivers 404.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A driving circuit for driving a relay, the driving circuit comprising:

a first relay driver for selectively connecting a coil of the relay with (a) a first current path between the first relay driver and a relay voltage input or (b) a second current path between the first relay driver and a ground connection; and a second relay driver for selectively connecting the coil with (a) a third current path between the second relay driver and the relay voltage input or (b) a fourth current path between the second relay driver and the ground connection;

the relay drivers operable to connect the coil between the second and third current paths to configure the driving circuit for latching the relay, and operable to connect the coil between the first and fourth current paths to configure the driving circuit for unlatching the relay;

the driving circuit further operable to apply a first signal from the relay voltage input through the coil to latch the relay, and to apply a second signal from the relay voltage input through the coil to unlatch the relay, the first and second signals having opposite polarities and different voltage magnitudes.

2. The driving circuit of claim 1, operable to unlatch the relay upon receiving the second signal at a voltage magnitude lower than the voltage magnitude of the first signal.

3. The driving circuit of claim 1, wherein the first relay driver comprises a first switch configured to apply the second signal to unlatch the relay.

4. The driving circuit of claim 3, wherein the first switch comprises a bias resistor transistor (BRT).

5. The driving circuit of claim 1, wherein the first relay driver comprises first and second switches each configured to receive a first processor input signal, and the second relay driver comprises third and fourth switches each configured to receive a second processor input signal;

the relay driving circuit configured to latch or unlatch the relay based on the first and second processor input signals.

6. The driving circuit of claim 5, wherein the switches comprise one or more bipolar transistors.

7. The driving circuit of claim 5, wherein at least one of the switches comprises a digital transistor having internal resistance.

8. The driving circuit of claim 1, wherein the first relay driver comprises a switch connected with the coil, the driving circuit made operable through the switch to unlatch the relay at a voltage magnitude lower than a voltage magnitude at which the driving circuit is operable to latch the relay.

9. The driving circuit of claim 1, operable to unlatch the relay using a relay voltage input signal of about 2.3 volts.

10. The driving circuit of claim 1, comprised by a thermostat.

11. A driving circuit for driving a relay having a coil, the driving circuit comprising:

a first relay driver having first and second switches selectively switchable to connect a first end of the coil with (a) a first current path between the first switch and a relay voltage input or (b) a second current path between the second switch and a ground connection; and a second relay driver having third and fourth switches selectively switchable to connect a second end of the coil with (a) a third current path between the third switch and the relay voltage input or (b) a fourth current path between the fourth switch and the ground connection;

the switches operable to connect the coil between the second and third current paths to configure the driving circuit for latching of the relay, and operable to connect the coil between the first and fourth current paths to configure the driving circuit for unlatching of the relay;

the driving circuit further configured to apply a first signal from the relay voltage input through the third switch to latch the relay, and to apply a second signal from the relay voltage input through the first switch to unlatch the relay, the first and second signals having opposite polarities, the first switch operable to unlatch the relay upon receiving the second signal at a voltage magnitude lower than a voltage magnitude of the first signal by which the third switch is operable to latch the relay.

12. The driving circuit of claim 11, wherein the first switch comprises a BRT transistor.

13. The driving circuit of claim 11, operable to unlatch the relay using a relay voltage input signal of about 2.3 volts.

14. The driving circuit of claim 11, comprised by a thermostat.

* * * * *